US011311931B2

(12) United States Patent
Li et al.

(10) Patent No.: US 11,311,931 B2
(45) Date of Patent: Apr. 26, 2022

(54) METHOD OF PREPARING A PARTICULATE REFRACTORY COMPOSITION FOR USE IN THE MANUFACTURE OF FOUNDRY MOULDS AND CORES, CORRESPONDING USES, AND RECLAMATION MIXTURE FOR THERMAL TREATMENT

(71) Applicant: HÜTTENES-ALBERTUS Chemische Werke Gesellschaft mit beschränkter Haftung, Düsseldorf (DE)

(72) Inventors: Xin Li, Beijing (CN); Christian Lustig, Düsseldorf (DE); Mirko Reinold, Hannover (DE); Maria Schweinefuß, Hannover (DE); Nicolas Egeler, Krefeld (DE)

(73) Assignee: HÜTTENES-ALBERTUS CHEMISCHE WERKE GESELLSCHAFT MIT BESCHRÄNKTER HAFTUNG, Düsseldorf (DE)

( * ) Notice: Subject to any disclaimer, the term of this patent is extended or adjusted under 35 U.S.C. 154(b) by 0 days.

(21) Appl. No.: 17/273,496

(22) PCT Filed: Sep. 6, 2019

(86) PCT No.: PCT/EP2019/073896
§ 371 (c)(1),
(2) Date: Mar. 4, 2021

(87) PCT Pub. No.: WO2020/049174
PCT Pub. Date: Mar. 12, 2020

(65) Prior Publication Data

US 2021/0339308 A1 Nov. 4, 2021

(30) Foreign Application Priority Data

Sep. 7, 2018 (EP) ..... 8193306

(51) Int. Cl.

| | |
|---|---|
| ***B22C 5/04*** | (2006.01) |
| ***B22C 5/10*** | (2006.01) |
| ***B22C 5/18*** | (2006.01) |
| ***B22C 1/02*** | (2006.01) |
| ***B22C 1/18*** | (2006.01) |

(52) U.S. Cl.
CPC ..... *B22C 5/04* (2013.01); *B22C 1/02* (2013.01); *B22C 1/181* (2013.01); *B22C 1/188* (2013.01); *B22C 5/10* (2013.01); *B22C 5/185* (2013.01)

(58) Field of Classification Search
CPC ..... B22C 1/02; B22C 1/181; B22C 1/188; B22C 5/04; B22C 5/10; B22C 5/185
See application file for complete search history.

(56) References Cited

U.S. PATENT DOCUMENTS

| | | | | |
|---|---|---|---|---|
| 4,008,856 | A | 2/1977 | Sears | |
| 5,567,743 | A | 10/1996 | Busby | |
| 6,015,846 | A | 1/2000 | Toussaint | |
| 6,286,580 | B1 | 9/2001 | Ward | |
| 2007/0173550 | A1 | 7/2007 | Busby | |
| 2008/0099180 | A1 | 5/2008 | Weicker | |
| 2010/0173767 | A1 | 7/2010 | Koch | |
| 2010/0252951 | A1 | 10/2010 | Ina | |
| 2010/0326620 | A1 | 12/2010 | Mueller | |
| 2014/0166226 | A1 | 6/2014 | Schwickal | |
| 2015/0174644 | A1 | 6/2015 | Deters | |
| 2015/0246387 | A1 | 9/2015 | Bartels | |
| 2016/0361756 | A1 | 12/2016 | Deters | |
| 2017/0106433 | A1* | 4/2017 | Yamashita | ..... B22C 1/188 |
| 2018/0056374 | A1 | 3/2018 | Muller | |

FOREIGN PATENT DOCUMENTS

| | | |
|---|---|---|
| DE | 102006061876 | 7/2008 |
| EP | 2359957 | 8/2011 |
| EP | 2692460 | 2/2014 |
| GB | 809283 | 2/1959 |
| WO | 2014019726 | 2/2014 |
| WO | 2014059968 | 4/2014 |
| WO | 2014059969 | 4/2014 |

OTHER PUBLICATIONS

Bernd Friede Friede, B., et al., "Microsilica—Ein Staub macht Karriere (Microsilica—A dust makes career)," Nachrichten aus der Chemie, Oct. 2011, 59(10):956-958.

* cited by examiner

*Primary Examiner* — Kevin E Yoon
(74) *Attorney, Agent, or Firm* — Duane Morris LLP; Gregory M. Lefkowitz

(57) ABSTRACT

Described is a method of preparing a particulate refractory composition for use in the manufacture of foundry moulds and cores from spent foundry moulds or cores formed of refractory material and a binder containing water glass, the method comprising the following steps: providing broken material from spent foundry moulds or cores or preparing broken material from spent foundry moulds or cores, wherein the broken material comprises particles and/or aggregates of particles of refractory material having hardened water glass binder on their surface, mixing the broken material with particulate amorphous oxide comprising silicon dioxide in an amount of 85% by weight or more, based on the total amount of the particulate amorphous oxide, to give a mixture and subjecting the mixture to a heat treatment at a temperature of 400° C. or higher. Also described are a corresponding use, a reclamation mixture, and a method of making a foundry mould or core.

20 Claims, No Drawings

METHOD OF PREPARING A PARTICULATE REFRACTORY COMPOSITION FOR USE IN THE MANUFACTURE OF FOUNDRY MOULDS AND CORES, CORRESPONDING USES, AND RECLAMATION MIXTURE FOR THERMAL TREATMENT

CROSS-REFERENCE TO RELATED APPLICATIONS

This application is a § 371 national stage entry of International Application No. PCT/EP2019/073896, filed on Sep. 6, 2019, which claims priority to European Patent Application No. 18193306.0, filed on Sep. 7, 2018, the entire contents of which are incorporated herein by reference.

The invention relates to a method of preparing a particulate refractory composition for use in the manufacture of foundry moulds and cores, corresponding uses and a reclamation mixture for thermal treatment.

More particularly, according to a first aspect, the invention relates to a specific method of preparing a particulate refractory composition (hereinafter according to the terminology typically used in practice also referred to as "sand") which is suitable for use in the manufacture of foundry moulds and cores, wherein the particulate refractory composition is prepared from spent foundry moulds or cores formed of refractory material and a binder containing water glass. Even more particularly, the invention relates to a method of preparing a particulate refractory composition (i.e. sand, see above) by reclamation of foundry sands from spent foundry moulds and cores formed of refractory material and a binder containing water glass.

According to a second aspect, the invention relates to the use of an aqueous suspension comprising an aqueous liquid phase comprising water in an amount of 80% by weight or more, based on the total amount of the liquid phase, and particulate amorphous oxide (see below for a definition) comprising silicon dioxide in an amount of 85% by weight or more, based on the total amount of the particulate amorphous oxide, as a constituent of a reclamation mixture comprising a specific broken material from spent foundry moulds or cores.

According to a third aspect, the invention relates to a specific reclamation mixture for thermal treatment, comprising (i) broken material from spent foundry moulds or cores, wherein the broken material comprises particles and/or aggregates of particles of refractory material having hardened water glass binder on their surface, and (ii) an aqueous suspension as further specified below, in particular in the context of the second aspect of the invention.

According to a fourth aspect, the invention relates to a specific method of making a foundry mould or core, wherein a particulate refractory composition is used which is prepared according to the method of the invention, see the first aspect, above, and the description below.

Broken material from spent foundry moulds and cores is a material used in the aspects of the present invention. In many cases it is a material prepared by 1. bonding foundry sand (particulate refractory composition) with an alkaline inorganic binder (e.g. (i) modified silicates in combination with inorganic oxides or (ii) water glass binders comprising silicon dioxide and alkali metal oxides in a defined ratio),
2. curing the inorganic binder in a manner known per se, and
3. breaking said mould or core after use, i.e. breaking the spent foundry mould or core.

Other preparation methods are also known and belong to the common general knowledge.

The use of alkaline inorganic binders (e.g. binders containing water glass) for the making of foundry moulds or cores is known for many years. Typical examples for the use of alkaline inorganic binders are hot core box curing processes wherein the liquid binder (part I) and/or additive (part II) is cured in a hot core box. If alkaline inorganic binders are used, curing can also (or additionally) be achieved by gassing with hot air. In other processes foundry moulds or cores are cured by gassing with carbon dioxide or adding an ester. The alkaline inorganic binder is usually prepared by modifying water glass with alkali (sodium, potassium and/or lithium) in a defined $SiO_2$:$M_2O$ (wherein M=Na, K, and/or Li) ratio (also named modulus) under alkaline conditions.

There are several alkaline inorganic binder systems, comprising water glass, known for manufacturing foundry moulds and cores. Such foundry moulds and cores when used in casting processes finally result in (after the respective foundry mould or core has been used) the broken material, which is an appropriate starting material for the purposes of the present invention. Broken material from spent foundry moulds or cores, which comprises particles and/or aggregates of particles of refractory material having hardened water glass binder on their surface, acts as starting material in methods of the present invention, since the broken material should be cleaned from hardened water glass remaining on its surface before it is suitable for reuse in the manufacture of (new) foundry moulds and cores.

Foundry moulds and cores manufactured by using water glass binder systems have in common that a high amount of alkalinity is present in said mixtures. Advantages of water glass binder systems are technological advantages like no emissions of BTX (BTX=mixtures of benzene, toluene, and xylene isomers) and no smoke emission during the manufacture of foundry moulds or cores and/or during a casting process using the respective foundry moulds or cores. Disadvantages are that the water glass binder systems are supplemented with high amounts of alkali metal hydroxides and/or alkali metal oxides. This high alkalinity (resulting from the presence of high amounts of alkali metal hydroxides and/or alkali metal oxides) mainly remains in the spent foundry sands after casting in the form of hardened water glass binder, in particular in the form of oxides and hydroxides of alkali metals. Conventional reclamation methods (e.g. mechanical attrition or thermal treatment) do not sufficiently remove the residual hardened water glass binder or the alkalinity from said spent foundry sands.

Washing of the sand to remove residual hardened water glass binder (i.e. soluble alkaline components) would be an ideal solution to clean the sand. However, such washing process is not practicable as it would create vast quantities of polluted waste water as well as high energy costs for drying the sand.

Recently, the interest in the use of alkaline water glass binder systems for the manufacture of foundry moulds or cores has increased because of their environmental friendliness compared to solvent containing and amine-cured Urethane binder systems used in cold-box curing processes.

Consequently, there is an increasing demand to recycle/reclaim foundry sands (particulate refractory composition for use in the manufacture of foundry moulds and cores) from water glass bonded foundry moulds and/or cores after casting. For environmental and commercial reasons, it is desirable to reclaim and reuse as much foundry sand as possible and to remove the high amount of alkalinity in order to save costs on dumping.

One known conventional method of sand reclamation is a mainly mechanical reclamation and comprises attrition of the bonded sand from spent foundry moulds or cores to provide broken material.

When working with reclaimed (water glass bonded) sand obtained after attrition, hardened water glass binder remains on its surface and as a result, the consumption of acid and the electrical conductivity value are generally far higher compared to new sand or reclaimed sand from other non-alkaline or organic binder systems. Furthermore, the bench life (i.e. the time during which a moulding sand can still be moulded without any significant loss of performance, counted from a moment in which all components—necessary for binding reaction—are homogenized in a mixer) of a mixture comprising (fresh) water glass binder and reclaimed water glass bonded sand obtained after attrition is typically far shorter compared to the bench life of a mixture comprising (fresh) water glass binder and new sand or reclaimed sand from other (in particular, non-alkaline and/or organic binder) systems. As a result, foundry moulds or cores on the basis of reclaimed water glass bonded sand obtained after attrition and containing (again) water glass as a binder are more inconvenient to manufacture and have (depending on the quantity of hardened water glass binder on the surface of the reclaimed water glass bonded sand used) a considerably reduced strength compared to the strength of foundry moulds or cores obtained with new sand. Moreover, the surface quality of castings (produced with foundry moulds or cores made with reclaimed water glass bonded sand obtained after attrition) in many cases is also worse compared to the use of foundry moulds or cores made with new sand. Furthermore, foundry cores on the basis of reclaimed water glass bonded sand obtained after attrition typically are difficult to compact, resulting in a reduced core weight compared to the core weight of foundry cores of the same design but made with new sand. Additionally, the humidity resistance of foundry moulds and cores on the basis of reclaimed water glass bonded sand obtained after attrition is typically reduced compared to the humidity resistance of foundry moulds or cores obtained with new sand.

Conventional attrition processes typically allow only for a reclamation rate of 70 to 85% for water glass bonded sand and in practice demand a significant addition of new sand (or otherwise reclaimed water glass bonded sand, or mechanically reclaimed sand that was originally exposed to a another binder system, e.g. non-alkaline or organic binder systems) to maintain acceptable performance levels.

Thus, water glass bonded spent foundry moulds or cores conventionally reclaimed by attrition show limited application properties due to the remaining amount of hardened water glass binder on their surface.

In order to avoid or alleviate such negative effects as described above additional reclamation processes are in many cases employed after mechanical attrition of water glass bonded spent foundry sands. A further step of sand reclamation can involve a heat treatment following the mechanical attrition. Insofar, a known technique is to heat the sand in a fluidized bed to more than 400° C. (further details are provided below in the specification). However, it has been found that especially in the case of alkaline binders (as e.g. water glass binders), probably due to their high content of alkalinity, heat treatment can lead to agglomeration of the sand grains and preventing the fluidized bed from properly functioning. This negative effect is sometimes described as fritting or sintering of the fluidized bed. This fritting/sintering process is a physicochemical process resulting in the formation of solidified objects which means the fusion or agglomeration of particulate, powdery substances (e.g. sand grains) under increased temperatures. In the context of the present invention, this fritting/sintering process is undesirable and should be avoided.

Thermal treatment of water glass contaminated foundry sands is known from the state of the art. In this respect, DE 10 2007 008 149 A1 discloses a method for regenerating used foundry sand with water glass adhered thereto, wherein a used foundry sand is provided comprising adhered to the foundry sand a binding agent based on water glass; and the used foundry sand is subjected to a thermal treatment, wherein the used foundry sand is heated to a temperature of at least 200° C.

A number of patents are known which disclose the addition of various additives that aim to prevent fritting/sintering or to otherwise improve the quality of thermally and/or mechanically reclaimed sand. EP 2 191 908 A1 discloses the use of silicon oils as additives for improved mechanical reclamation of sands. According to own experiments, this additive does not remove the alkalinity and is therefore not ideal.

EP 0 949 978 B1 discloses the use of carbohydrates as additives added prior to heat treatment to prevent sand grain fusion. However, this method in own experiments proved unsuccessful as no or too little potassium is removed and the potassium content of the reclaimed sand became too high with intensive reuse therefore compromising the rebond strength and refractoriness. Additionally, in own experiments smelly emissions were observed when conducting the treatment according to EP 0 949 978 B1.

WO 94/05448 discloses the use of additives like halogen acids, sulphuric acid, boric acid and ammonium salts of these acids that react with potassium compounds to form salts that have a melting point of at least 550° C., preferably above 700° C. The unacceptable disadvantage of this process in own experiments was that a high degree of corrosion was observed in the treatment plants.

WO 94/26439 A1 discloses the use of particulate active clay additives added prior to the heat treatment. It is disclosed that the strength levels obtained with reclaimed sand are improved and that the level of elutable alkali is dramatically reduced after the reclamation process. However, in own experiments it has been found that with this additive the strength levels drop with each reclamation cycle and was too low to reliably manufacture cores or moulds. Furthermore, EP 1 753 560 B1 discloses that the process of WO 94/26439 A1 suffers from the disadvantage that very fine clay particles are retained with the treated sand with a resultant lack of potassium (or other alkali) removal.

Furthermore, patents are known which disclose the use of reclaimed sand for the manufacture of foundry moulds and cores. In this respect, EP 2 359 957 A1 discloses a foundry moulding composition for the manufacture of foundry moulds and cores, comprising sand; a binder; and silica fume and/or a silica fume substitute, wherein the sand comprises reclaimed sand comprising alkaline binder residues.

Further related documents are WO 2013/026579 A1, DE 102012020509 A1, DE 102012020510 A1, DE 102012020511 A1, US 2018/0056374 A1, DE 102006061876 A1, DE 102007051850 A1, DE 102012104934 A1, DE 102013111626 A1, US 2010/0173767 A1, EP 1802409 B1, EP 2 692 460 B1, WO 2014/019726 A1, GB 809,283 A and U.S. Pat. No. 4,008,856 A.

A primary object of the present invention is to provide an alternative or improved method of preparing a particulate refractory composition for use in the manufacture of foundry moulds and cores from spent foundry moulds or cores formed of refractory material and a binder containing water glass. The method should preferably contribute to avoid or at least alleviate at least some problems or disadvantages associated with the prior art methods discussed above. In particular, the method should preferably contribute to or allow for removing or transforming hardened water glass binder from the surface of particles and/or aggregates of particles to be processed, so that negative effects caused by such hardened water glass are alleviated or avoided.

According to the present invention the primary object is achieved by (A) a method of preparing a particulate refractory composition for use in the manufacture of foundry moulds and cores from spent foundry moulds or cores formed of refractory material and a binder containing water glass, the method comprising the following steps:

- providing broken material from spent foundry moulds or cores or preparing broken material from spent foundry moulds or cores, wherein the broken material comprises particles and/or aggregates of particles of refractory material having hardened water glass binder on their surface,
- mixing the broken material with particulate amorphous oxide comprising silicon dioxide in an amount of 85% by weight or more, based on the total amount of the particulate amorphous oxide, to give a mixture and

- subjecting the mixture to a heat treatment at a temperature of 400° C. or higher.

Typically, the resulting product (heat treated mixture) is then used in further steps (for details see below) as a particulate refractory composition to manufacture said foundry moulds or cores, respectively.

According to the present invention, the primary object is also achieved by (B) a method of cleaning the surface of broken material from spent foundry moulds or cores, the broken material comprising particles and/or aggregates of particles of refractory material having hardened water glass binder on their surface, the method comprising the following steps:

- providing broken material from spent foundry moulds or cores or preparing broken material from spent foundry moulds or cores, wherein the broken material comprises particles and/or aggregates of particles of refractory material having hardened water glass binder on their surface,
- mixing the broken material with particulate amorphous oxide comprising silicon dioxide in an amount of 85% by weight or more, based on the total amount of the particulate amorphous oxide, to give a mixture and

- subjecting the mixture to a heat treatment at a temperature of 400° C. or higher.

Typically, the resulting product (i.e. a product comprising heat treated broken material having a cleaned surface) is then used in further steps (for details see below) as a particulate refractory composition to manufacture new foundry moulds or cores, respectively.

Hereinafter, statements made with respect to (A) the inventive method of preparing a particulate refractory composition for use in the manufacture of foundry moulds and cores from spent foundry moulds or cores formed of refractory material and a binder containing water glass also relate to (B) the inventive method of cleaning the surface of broken material from spent foundry moulds or cores, and vice versa.

Within the scope of the present invention, "water glass" is understood to mean alkali water glass known per se, which is solidified from a melt and comprises vitreous, i.e. amorphous, water-soluble sodium, potassium and lithium silicates or aqueous solutions of the aforementioned sodium, potassium and lithium silicates (=aqueous form of water glass).

"Aggregates of particles" are understood as fused or sintered clusters of (primary) "particles". In the context of the present invention, aggregates of particles typically originate from the casting process or processes (which are conducted at high temperatures) to which the spent foundry moulds or cores formed of refractory material and a binder containing water glass were typically subjected prior to their use as starting material for the method according to the invention. In the course of preparing broken material from spent foundry moulds or cores it is possible that in a first step aggregates of particles of refractory material having hardened water glass binder on their surface are formed which are then (partially or completely) further converted into (individual, primary) particles of refractory material having hardened water glass binder on their surface.

(First) particles and/or aggregates of particles of refractory material having hardened water glass binder on their surface, which are present in the broken material from spent foundry moulds or cores, may be bonded to (second) particles and/or aggregates of particles of refractory material having hardened water glass binder on their surface, in particular by means of the (water glass) binder used in the respective foundry mould or core.

"Hardened water glass binder" is understood as a binder containing water glass prepared from the aqueous form of water glass, which has been hardened, and preferably for hardening has been solidified by removal of water and/or other liquid constituents, or has been crosslinked by using a $CO_2$ gas, or an air/$CO_2$ gas mixture or an ester. or ester blend. The hardening of the aqueous form of water glass is preferably carried out by heating and/or other removal of liquid constituents.

"Particulate amorphous oxide comprising silicon dioxide" comprises as constituent(s)

(i) one or more particulate amorphous silicon dioxides and no other oxide or (ii) a mixture of one or more particulate amorphous silicon dioxides and one or more other particulate amorphous oxides or (iii) an amount of amorphous particles, wherein each of said particles comprises a mixture of silicon dioxide and one or more other oxides, wherein this amount of amorphous particles is optionally present in admixture with one or more constituents selected from the group consisting of particulate amorphous silicon dioxides and particulate amorphous oxides other than silicon dioxide. This means that the particulate amorphous oxide may comprise amorphous particles that are formed from more than one type of oxide (e.g., as in particles of amorphous borosilicate glass).

It has surprisingly been found that the treatment of broken material from spent foundry moulds or cores, wherein the broken material comprises particles and/or aggregates of particles of refractory material having hardened water glass binder on their surface, with particulate amorphous oxide comprising silicon dioxide in an amount of 85% by weight or more, based on the total amount of the particulate amorphous oxide, reduces the likelihood of (further) fritting/sintering of the particles or aggregates (e.g., sand grains), and does not significantly disturb the flowability of a fluidized bed in a reclamation unit. Furthermore, said particulate amorphous oxide used for the treatment does not bind sand particles and is typically fully removable from the mixture by dedusting, and along with the dust/fines advantageously a high amount of alkali metal ions (for example sodium ions) can be removed. Thus, by the treatment of broken material from spent foundry moulds or cores, wherein the broken material comprises particles and/or aggregates of particles of refractory material having hardened water glass binder on their surface, with particulate amorphous oxide comprising silicon dioxide in an amount of 85% by weight or more, based on the total amount of the particulate amorphous oxide, the consumption of acid (COA) as well as the electrical conductivity of the treated (reclaimed) broken material are reduced. This results in an improvement of the bench life of a mixture comprising (fresh) water glass binder and the particulate refractory composition obtained by the method of the present invention as well as in an improvement of the surface quality of castings produced with foundry moulds or cores made with the corresponding particulate refractory composition obtained by the method of the present invention.

Furthermore, it has surprisingly been found that in comparison with a process not using particulate amorphous oxide but being otherwise identical, the treatment of broken material from spent foundry moulds or cores, wherein the broken material comprises particles and/or aggregates of particles of refractory material having hardened water glass binder on their surface, with particulate amorphous oxide comprising silicon dioxide in an amount of 85% by weight or more, based on the total amount of the particulate amorphous oxide, reduces the treatment time necessary as well as the temperature necessary to be applied during the treatment. Thus, by the treatment of broken material from spent foundry moulds or cores, wherein the broken material comprises particles and/or aggregates of particles of refractory material having hardened water glass binder on their surface, with particulate amorphous oxide comprising silicon dioxide in an amount of 85% by weight or more, based on the total amount of the particulate amorphous oxide, also significant energy savings can be realized.

The method according to the invention is preferably directed to preparing a particulate refractory composition for use in the manufacture of foundry moulds and cores from spent foundry moulds or cores formed of refractory material and a binder containing water glass, wherein the binder containing water glass is a (inorganic) water glass binder. Water glass binders are typically prepared by mixing silicon dioxide and alkali metal oxides (sodium oxide and/or potassium oxide and/or lithium oxide) in a defined $SiO_2$:$M_2O$ (wherein M=Na, K and/or Li) ratio (also named modulus) under alkaline conditions to obtain water glass binders. The defined $SiO_2$:$M_2O$ molar ratio of the obtained water glass binders typically is in the range of from 1.8:1.0 to 4.1:1.0 and the typical solid material content is in the range of from 27 to 56% by weight, based on the total weight of water glass binder. Foundry moulds and cores manufactured with said water glass binders are in most cases excellent starting materials for the method of the invention. Correspondingly, the hardened water glass binder present on the surface of the particles and/or aggregates is the hardened product of such preferably inorganic water glass binders.

The method of the invention and the particulate amorphous oxide used therein is particularly useful in cleaning the surfaces of particulate material (sand) from such water glass binders. The properties of a (cleaned) particulate refractory composition, reclaimed from spent foundry moulds or cores formed of refractory material and a binder containing water glass, are close to the properties of the corresponding virgin particulate refractory composition, i.e. the particulate refractory composition present before first contact with binder (e.g., new sand); and typically better than particulate refractory material from spent foundry moulds or cores, reclaimed by mechanical attrition and/or thermal treatment alone. However, in order to further improve the application properties of foundry moulds and cores the particulate refractory composition, reclaimed from spent foundry moulds or cores according to the method of the invention, can be optionally mixed with virgin particulate refractory composition. Particularly surprising and positive results have been achieved in methods of the present invention wherein the water glass binder (which is to be removed in the reclamation process) is a preferred binder as defined above. The properties of a (cleaned) particulate refractory composition, prepared according to the invention, are improved compared to a particulate refractory composition, reclaimed from spent foundry moulds or cores formed of refractory material and a binder containing water glass, not treated according to the method of the invention.

The amount of particulate amorphous oxide used in the method of the present invention is preferably selected in a such way that the alkali content of the broken material from spent foundry moulds or cores is reduced during the heat treatment of the invention, in comparison with a method not comprising the step of mixing said broken material with particulate amorphous oxide but being otherwise identical.

In practice, the skilled person will typically conduct a number of simple experiments in order to identify an appropriate particulate amorphous oxide comprising silicon dioxide (as defined above), including the preferred constituents and their relative amounts, and an appropriate amount of the corresponding particulate amorphous oxide, for a given type and amount of broken material. Of course, the appropriate particulate amorphous oxide and the appropriate amount of particulate amorphous oxide will also be determined by the apparatus available for mixing and heat treatment etc. The person skilled in the art knows methods which can be used to verify the appropriate amount and type of particulate amorphous oxide.

The concepts of DIN 51730 for example provide a method (Testing of solid fuels—Determination of fusibility of fuel ash) to verify the results achieved with defined amounts and types of particulate amorphous oxides by determining the cross sectional area values of specimens manufactured with heat treated broken material. These cross sectional area values indicate the progress of fritting/sintering in dependence of the temperature. As another example, the skilled person can take pictures of heat treated broken material with an optical microscope to analyze the surfaces of heat treated particles. Such an analysis advantageously shows whether the surfaces are clean or still covered by impurities, such as remaining binder material. Both methods are suitable to determine the appropriate amount and type of particulate amorphous oxide, in particular for brow ken material (sand) which has been obtained from spent foundry moulds or cores formed of refractory material and a binder containing water glass. An optical analysis using a microscope is a preferred method to analyze sand grain particles and to identify whether and to which extent sintering and/or fritting has occurred (in comparison with a method not comprising mixing the broken material with particulate amorphous oxide but being otherwise identical). The appropriate amount and type of particulate amorphous oxide for a given type and amount of broken material can furthermore be determined by measuring the electrical conductivity and/or the consumption of acid (COA) of said broken material, before and after treatment, since both values are appropriate indicators of the degree of contamination.

An important parameter of the heat treatment in a method according to the invention is the temperature. The method according to the invention relates to a method (as described above, in particular as designated as being preferred), wherein the heat treatment is at a temperature of 400° C. or higher. In a preferred embodiment of the method according to the invention, the heat treatment is at a temperature in the range of from 400 to 750° C., preferably in the range of from 570 to 730° C., more preferably in the range of from 630 to 730° C., most preferably in the range of from 670 to 730° C. The method of the invention and the particulate amorphous oxide used therein, is particularly useful in cleaning the surfaces of broken material (sand) from remaining binder containing water glass. This cleaning process is carried out at a temperature of 400° C. or higher because at this temperature the heat treatment ensures a complete melting of the remaining binder as well as a complete withdrawal of residual water from the remaining binder containing water glass. Furthermore, a heat treatment at a temperature of 400° C. or higher results in a removal, i.e. a burning/combustion, of any organic (carbonaceous) compounds potentially present in the broken material.

Temperatures below 400° C. usually (i) do not guarantee a satisfying burning/combustion of organic (carbonaceous) compounds (if present) and/or, in this context, (ii) lead to accumulation of residual carbon. Moreover (iii) the residual water glass binder on the surface of the particles/aggregates of refractory material below 400° C. is still in a solid state (or at least in a state of high viscosity) which prevents a full contact between the alkali metal ions of the water glass binder on the surface and the particulate amorphous oxide, so that the reclamation does not sufficiently proceed. On the other hand, temperatures above 750° C. in some cases appear to increase the likelihood of fritting/sintering of the broken material during heat treatment. Additionally, mechanical wear and energy consumption increase sharply at higher temperatures. So, the heat treatment is preferably conducted at a temperature in the range of from 400 to 750° C.

The method according to the invention can be carried out in various scales and may e.g. include mixtures (comprising the broken material and particulate amorphous oxide) of less than 1 kg (e.g. 500 g) up to 15 tons.

The method according to the invention (as described above, in particular as designated as being preferred) can be carried out as a batch process or as a continuous process. Both processes can be performed in a thermal reclamation unit (this means a thermal reclamation unit particular for sand reclamation) capable of providing suitable temperatures during heat treatment. In most cases, the thermal reclamation unit advantageously provides stable and reproducible treatment conditions during the heat treatment. Continuously operating thermal reclamation units can be (but are not necessarily) part of a thermal reclamation plant which is commercially available (e.g. CHIN YING Foundry Material (Tianjin) Sand Reclamation Plant typically comprising an "Energy-Saving Counter Flow Furnace SX2-5-12" thermal reclamation unit; CHIN YING foundry material Co., LTD).

Furthermore, in the method according to the invention (as described above, in particular as designated as being preferred), the heat treatment at a temperature of 400° C. or higher is preferably conducted in a fluidized bed or thermal sand reclamation unit, wherein simultaneous with or after the heat treatment in the fluidized bed or thermal sand reclamation unit dust and/or fines and/or solid matter, comprising remainders of the particulate amorphous oxide and alkali ions (in particular from the water glass binder on the surface of the particles/aggregates of the broken material), are preferably removed.

As mentioned above, the heat treatment of the mixture in a method according to the invention leads to the melting of constituents of the remaining binder containing water glass, present in the corresponding broken material. It is therefore preferred that the mixture is stirred up or moved in order to improve the effects of the heat treatment. For this purpose, the heat treatment in the method according to the invention is more preferably carried out using fluidization of the mixture in a fluidized bed or movement (mixing movement) in a thermal sand reclamation unit such as a rotary reclamation apparatus. A rotary reclamation apparatus is for example disclosed in U.S. Pat. No. 6,286,580 B1. Fluidization of the mixture in the method according to the invention is more preferably achieved in a thermal reclamation unit or a thermal reclamation plant (as described above). The skilled person is familiar with the appropriate conditions in order to carry out such heat treatment step.

In the method according to the invention (as described above, in particular as designated as being preferred) the step of preparing broken material from spent foundry moulds or cores, wherein the broken material comprises particles and/or aggregates of particles of refractory material having hardened water glass binder on their surface, preferably comprises a mechanical treatment of material from spent foundry moulds or cores comprising refractory material and a binder containing water glass so that the material is broken, wherein preferably the broken material comprises particles of refractory material having hardened water glass binder on their surface.

For the purposes of the present invention, the spent foundry moulds or cores formed of refractory material and a binder containing water glass are broken in particles and/or aggregates of particles before mixing the broken material with particulate amorphous oxide. On the one hand, the breaking of the spent foundry moulds or cores formed of refractory material and a binder containing water glass has the advantage that it facilitates the further processing and handling of the bulky spent foundry moulds or cores. On the other hand, the resulting broken material from spent foundry moulds or cores possesses a significantly larger surface compared to the bulky spent foundry moulds, enabling an intensive mixing (and thus, a necessary high contact) with the particulate amorphous oxide. The mixing of the broken material from spent foundry moulds or cores with the particulate amorphous oxide is even more intensified the more broken material is present as particles of refractory material having hardened water glass binder on their surface, i.e. the less broken material is present as aggregates of particles of refractory material having hardened water glass binder on their surface.

As stated, the breaking of the spent foundry moulds or cores formed of refractory material and a binder containing water glass comprises preferably a mechanical treatment step. Common mechanical treatment (e.g. grinding or shredding) are familiar to the skilled person. Breaking (e.g. crushing/fragmentation) of the spent foundry moulds, which comprise refractory material and hardened water glass binder, results in particles and/or aggregates of particles also comprising refractory material and hardened water glass binder, whereby (as a result of the breaking) the hardened water glass binder is on the surface of the particles and/or aggregates of particles and is therefore accessible to direct contact with particulate amorphous oxide.

Preferably, the mechanical treatment comprises two or more successive breaking steps in order to convert the material from spent foundry moulds or cores comprising refractory material and a binder containing water glass into particles and/or aggregates of particles of refractory material having hardened water glass binder on their surface. In this respect, the term "to convert" is to be understood in the sense of a conversion. The two or more successive "breaking steps" can represent both the multiple repetition of an identical breaking step and the conduction of two or more different breaking steps.

In the method according to the invention (as described above, in particular as designated as being preferred)

the step of mixing the broken material with the particulate amorphous oxide is preferably conducted in the presence of a liquid phase, preferably in the presence of an aqueous liquid phase, more preferably in the presence of an aqueous liquid phase comprising water in an amount of 80% by weight or more, based on the total amount of the liquid phase, wherein the step of mixing is preferably conducted in the presence of one or more organic compounds as constituents of the aqueous liquid phase, and/or in the step of mixing the broken material with the particulate amorphous oxide the broken material is preferably mixed with a suspension of the particulate amorphous oxide in a liquid phase, wherein preferably the liquid phase is an aqueous liquid phase, wherein more preferably the liquid phase is an aqueous liquid phase comprising water in an amount of 80% by weight or more, based on the total amount of the liquid phase, wherein preferably the aqueous liquid phase comprises one or more organic compounds.

In order to mix the particulate amorphous oxide comprising silicon dioxide in an amount of 85% by weight or more, based on the total amount of the particulate amorphous oxide, with broken material from spent foundry moulds or cores a particularly practical way is to add the said particulate amorphous oxide in the presence of a liquid phase, i.e. as a suspension of the particulate amorphous oxide in a liquid phase. One advantage is that a suspension can be accurately and easily dosed. Furthermore, mixing the broken material with a suspension prevents dust formation and facilitates homogenous mixing with the particulate amorphous oxide. As liquid phase or as suspending agent, preferably an aqueous phase or an aqueous suspending agent is used, since water can be classified as harmless with regard to its toxicological and ecological effect. Accordingly, preferably aqueous liquid phases or aqueous suspending agents are used which comprise water to a large extent, preferably in an amount of 80% by weight or more, based on the total amount of the liquid phase. Thus, suspensions as preferably used in the method according to the invention (as described above, in particular as designated as being preferred) are preferably suspensions of particulate amorphous oxide in an aqueous liquid phase comprising water in an amount of 80% by weight or more, based on the total amount of the liquid phase. Said suspensions are advantageously storage-stable and usually exhibit a defined composition of constituents. This ensures stable and reproducible process conditions in a method according to the invention.

Although the use of water as a liquid phase or as a suspending agent is preferred, the presence of one or more organic compounds as constituents of the aqueous liquid phase may nevertheless be advantageous and desirable in the context of the present invention, in particular cases. The presence of one or more organic compounds can positively influence the wettability, stability, viscosity, shelf life, flowability and/or other properties of the aqueous liquid phase. Examples for organic compounds to be preferred are surfactants, suspension agents and thickeners (For details regarding organic compounds to be preferred see the specifications below). A suspension of the particulate amorphous oxide in a liquid phase can be prepared by mixing particulate amorphous oxide with a liquid phase (such as water) and/or one or more organic compounds by means of a high-performance mixer.

In the method according to the invention (as described above, in particular as designated as being preferred) the broken material is preferably also mixed, simultaneously or successively, with one or more materials selected from the group consisting of phyllosilicates, preferably selected from the group consisting of kaolinite, metakaolin, montmorillonite, halloysite, hectorite, smectite, muscovite, pyrophyllite, synthetic phyllosilicates and mixtures thereof, wherein preferably the phyllosilicates are partially or completely calcined, preferably as a pre-mixture with the particulate amorphous oxide, more preferably as a pre-mixed suspension in a liquid phase also comprising the particulate amorphous oxide, wherein preferably the liquid phase is an aqueous liquid phase, wherein more preferably the liquid phase is an aqueous liquid phase comprising water in an amount of 80% by weight or more, based on the total amount of the liquid phase, wherein preferably the aqueous liquid phase comprises one or more organic compounds, suspending agents, preferably illite containing clay, smectite and/or attapulgite, wetting agents, dispersing agents, anti-settling agents, dyes, pigments, biocides, preferably fungicides, zeolites, and aluminium hydroxide.

It has surprisingly been found that the presence of phyllosilicates in a mixture of broken material with particulate amorphous oxide exerts a particularly positive influence on the reclamation of the broken material during the heat treatment of the method according to the invention, in particular if the phyllosilicates and the particulate amorphous oxide are first (homogeneously) pre-mixed before the mixing with the broken material takes place and/or the pre-mixture is supplied as suspension in a liquid phase like water. Furthermore, in suspension the phyllosilicates cause an increased stabilization of the particulate amorphous oxide, resulting in the prevention or at least a slowdown of a separation between solid material and liquid phase, when the suspension is stored for a longer time.

Thus, in a preferred embodiment of the method of preparing a particulate refractory composition for use in the manufacture of foundry moulds and cores from spent foundry moulds or cores formed of refractory material and a binder containing water glass, the method comprises the following steps:

providing broken material from spent foundry moulds or cores or preparing broken material from spent foundry moulds or cores, wherein the broken material comprises particles and/or aggregates of particles of refractory material having hardened water glass binder on their surface, providing a pre-mixture, comprising phyllosilicates, preferably selected from the group consisting of kaolinite, metakaolin, montmorillonite, halloysite, hectorite, smectite, muscovite, pyrophyllite, synthetic phyllosilicates and mixtures thereof, wherein preferably the phyllosilicates are partially or completely calcined, and particulate amorphous oxide comprising silicon dioxide in an amount of 85% by weight or more, based on the total amount of the particulate amorphous oxide preferably as a pre-mixed suspension in a liquid phase, wherein preferably the liquid phase is an aqueous liquid phase, wherein more preferably the liquid phase is an aqueous liquid phase comprising water in an amount of 80% by weight or more, based on the total amount of the liquid phase, wherein preferably the aqueous liquid phase comprises one or more organic compounds, mixing the broken material with the pre-mixture, to give a mixture (i.e. a mixture comprising in particular the broken material, the phyllosilicates, and the particulate amorphous oxide comprising silicon dioxide)

and subjecting the mixture to a heat treatment at a temperature of 400° C. or higher.

Although the addition of phyllosilicates as a pre-mixture (i.e. together with the particulate amorphous oxide) is in many cases preferred, in other embodiments the phyllosilicates are added separately (i.e. as pure compound) to the broken material and/or to a mixture of broken material and particulate amorphous oxide.

As typical in the art, suspending, dispersing and/or anti-settling agents are optionally added to the suspension in order to avoid or minimize sedimentation and to improve mixing with the broken material, in particular sand.

Wetting agents are optionally added to reduce the surface tension of the suspension.

Within the scope of the present invention, the optional use of biocides is preferred in order to prevent the suspension from being infested, in particular during prolonged storage. In a preferred embodiment of the method according to the invention, fungicides are applied in order to prevent the suspension from being infested with fungi, such as mildew.

The optional addition of zeolites and/or aluminium hydroxide further reduces the likelihood of fritting/sintering of the particles and/or aggregates of particles of the broken material.

The term "zeolite" refers to microporous, aluminosilicate minerals, which occur naturally but are also synthetically produced on a large scale. In the present specification the generic term "zeolites" refers to both and does not distinguish between natural and synthetic zeolites if not stated otherwise.

"Aluminium hydroxide", $Al(OH)_3$, sometimes erroneously called hydrate of alumina (in German: Tonerdehydrat), is found in nature as the mineral gibbsite (monoclinic; also known as hydrargillite) and its three, much more rare polymorphs: bayerite (hexagonal), doyleite and nordstrandite. Closely related are aluminium oxide hydroxide, AlO(OH), differing only by loss of water. These compounds together are the major components of the aluminium ore bauxite. Freshly precipitated aluminium hydroxide forms gels, which is the basis for application of aluminium salts as flocculants in water purification. This gel crystallizes with time.

The naming for the different forms of aluminium hydroxide is ambiguous and there is no universal standard. All four polymorphisms have a chemical composition of aluminium trihydroxide (an aluminium atom attached to three hydroxide groups).

Gibbsite is also known as hydrargillite, with gibbsite used most commonly in the United States and hydrargillite used more often in Europe. In 1930 it was referred to as α-alumina trihydrate to contrast it with bayerite which was called β-alumina trihydrate (the alpha and beta designations were used to differentiate the more- and less-common forms, respectively). In 1957 a symposium on alumina nomenclature attempted to develop a universal standard, resulting in gibbsite being designated $\gamma$-$Al(OH)_3$ and bayerite becoming $\alpha$-$Al(OH)_3$ and nordstrandite being designated $Al(OH)_3$. Based on their crystallographic properties, a suggested nomenclature and designation is for gibbsite to be $\alpha$-$Al(OH)_3$, bayerite to be designated $\beta$-$Al(OH)_3$ and both nordstrandite and doyleite are designated $Al(OH)_3$. Under this designation, the a and β prefixes refer to hexagonal, close-packed structures and altered or dehydrated polymorphisms respectively, with no differentiation between nordstrandiate and doyleite.

The term "Aluminium hydroxide" as used in the present text refers to any of the above mentioned different forms of aluminium hydroxide. For preferred forms see below.

If not indicated otherwise, the term "aluminium hydroxide" as used in the present text furthermore comprises aluminium oxide hydroxide, AlO(OH), differing from $Al(OH)_3$ only by loss of water. AlO(OH), exists in two forms: $\alpha$-AlO(OH) (Diaspor) and $\gamma$-AlO(OH) (Böhmit). Aluminium hydroxide is capable to form aluminates upon reacting with alkali metal hydroxides. The generic formula of such compounds is $M[Al(OH)_4]$, wherein M means the alkali metal ion.

In the method according to the invention (as described above, in particular as designated as being preferred) the particulate amorphous oxide comprising silicon dioxide in an amount of 85% by weight or more, based on the total amount of the particulate amorphous oxide, preferably comprises one more substances selected from the group consisting of silica fume, preferably selected from the group consisting of silica obtained by oxidation of metallic silicon with an oxygen containing gas, and silica obtained by thermal decomposition of $ZrSiO_4$ to $ZrO_2$ and $SiO_2$, amorphous silica,
precipitated silicic acid,
pyrogenic silicic acid, and
silica obtained by atomization of a silica melt and subsequent solidification.

Insofar, we note that specific substances might fall under more than one element from the group of preferred particulate amorphous oxides comprising silicon dioxide, as defined above. In other words, the elements of the group may overlap.

Furthermore, the particulate amorphous oxide comprising silicon dioxide in an amount of 85% by weight or more, based on the total amount of the particulate amorphous oxide, may alternatively or additionally comprise one more substances disclosed in "Mikrosilica-ein Staub macht Karriere" (published in the journal "Nachrichten aus der Chemie" in volume 59 from 2011 on pages 956 to 958), i.e. (for example) one or more amorphous substances selected from the group consisting of "Kieselgel" (silica gel, CAS-number: 112926-00-8); "Lichtbogen-Silica" (literally translated this means: arc furnace silica); "Plasma-Silica" (literally translated this means: plasma silica); "Kieselgur" (diatomaceous earth, CAS-number: 61790-53-2); "kalzinierte Kieselgur" (calcined diatomaceous earth, CAS-number: 91053-39-3); "fluxkalzinierte Kieselgur" (flux calcined diatomaceous earth, CAS-number: 68855-54-9) and "Quarzglas, Kieselglas" (fused quartz, fused silica, CAS-number: 60676-86-0).

Silica fume (CAS-number: 69012-64-2, in German also known as "Mikrosilica") is typically produced as a by-product of the large-scale production of silicon and ferrosilicon in the electric arc furnace by reducing "quartz sand with coke or anthracite, first forming silicon monoxide gas which then further oxidizes to silicon dioxide. During subsequent cooling, the silicon dioxide formed condenses to a particulate, amorphous silicon dioxide called silica fume.

Silica fume preferably consists of almost perfect spheres of amorphous silicon dioxide, as electron microscopic investigations have shown. In contrast to other particulate amorphous oxides preferred according to the method of the present invention, the particles in silica fume are typically not sintered but are present as isolated spheres that form fully dispersible agglomerates. Since the primary particles of the silica fume are additionally very small (with a preferably weight average in the range of 100 nm to 150 nm), silica fume represents a very fine particulate amorphous oxide which is particularly easy to mix with the broken material to give a homogeneous mixture. The use of silica fume as particulate amorphous oxide is particularly preferred. The other particulate amorphous oxides, listed above, are likewise preferred for analogous reasons.

Furthermore, a method according to the invention (as described above, in particular as designated as being preferred) is preferred, with the following steps in the process of preparing broken material from spent foundry moulds or cores:

producing a moulding mixture comprising refractory material and a binder containing water glass and a particulate amorphous silicon dioxide,
moulding of the moulding mixture,
curing of the moulding mixture to give a cured foundry mould or core,
using the cured foundry mould or core in a metal casting process to give a spent foundry mould or core (note: the step of preparing broken material from the spent foundry mould or core has already been discussed above).

Even more preferred is a method according to the invention (as described above, in particular as designated as being preferred), with the following steps in the process of preparing broken material from spent foundry moulds or cores:

producing a moulding mixture comprising refractory material and a binder containing water glass and a particulate amorphous silicon dioxide,
moulding of the moulding mixture,
curing of the moulding mixture to give a cured foundry mould or core,
using the cured foundry mould or core in a metal casting process to give a spent foundry mould or core, further comprising a mechanical treatment of material from (said) spent foundry mould or core so that the material is broken, wherein preferably the broken material comprises particles of refractory material having hardened water glass binder on their surface and/or the mechanical treatment comprises two or more successive breaking steps in order to convert the material from spent foundry moulds or cores comprising refractory material and a binder containing water glass into particles and/or aggregates of particles of refractory material having hardened water glass binder on their surface.

The spent foundry moulds or cores formed of refractory material and a binder containing water glass which are used as starting material to prepare broken material as defined above, typically correspond to (old) spent foundry moulds, which were first used for metal casting before they were used as starting material for preparing broken material. The method according to the present invention thus enables the recycling of spent foundry moulds which are no longer suitable for the use in metal casting. For detailed information about the process of preparing broken material from spent foundry moulds or cores, we refer to EP 1802409 B1 and US 2010/0173767 A1. As can be seen from US 2010/0173767 A1, the spent foundry mould used for the process of preparing broken material may already contain particulate metal oxide as additive, whereby the particulate metal oxide originally contained in the spent foundry mould was not used as a reclamation agent but as an additive to increase the strength of the foundry mould. If a spent foundry mould already contains (old) particulate metal oxide, this does not render the use of (new) particulate amorphous oxide dispensable, in order to achieve the desired technical effect, achieved by the method according to the present invention.

Furthermore, a method according to the invention (as described above, in particular as designated as being preferred) is preferred, wherein the binder additionally comprises one or more compounds selected from the group consisting of phosphorus-containing compounds, preferably selected from the group consisting of sodium metaphosphate, sodium polyphosphate and mixtures thereof,
carbohydrates,
surfactants, preferably an anionic surfactant, more preferably carrying a sulfate, sulfonate, or phosphate group,
barium sulfate, and
oxidic boron compounds, preferably selected from the group consisting of borates, borophosphates, borophosphosilicates and mixtures thereof.

Also preferred is a method according to the invention (as described above, in particular as designated as being preferred), with the following steps in the process of preparing broken material from spent foundry moulds or cores:

- producing a moulding mixture comprising refractory material and a binder containing water glass and a particulate amorphous silicon dioxide,
- moulding of the moulding mixture,
- curing of the moulding mixture to give a cured foundry mould or core,
- using the cured foundry mould or core in a metal casting process to give a spent foundry mould or core (note: the step of preparing broken material from the spent foundry mould or core has already been discussed above)

and, wherein the binder additionally comprises one or more compounds selected from the group consisting of

- phosphorus-containing compounds, preferably selected from the group consisting of sodium metaphosphate, sodium polyphosphate and mixtures thereof,
- carbohydrates,
- surfactants, preferably an anionic surfactant, more preferably carrying a sulfate, sulfonate, or phosphate group,
- barium sulfate, and
- oxidic boron compounds, preferably selected from the group consisting of borates, borophosphates, borophosphosilicates and mixtures thereof.

The method according to the present invention is not limited to the usage of spent foundry moulds made with "pure" water glass as binder. Instead, spent foundry moulds which comprise additives, originating from the binder used or from other sources, are applicable as well. In cases wherein the binder comprises organic compounds, the temperature range selected for the temperature treatment of the method of the present invention ensures a complete (or a mostly complete) burning/combustion of organic (carbonaceous) material. The binder, used for the production of spent foundry moulds as used for the present invention, preferably comprises (beside water glass) the additional compounds mentioned above.

In the method according to the invention (as described above, in particular as designated as being preferred) the total amount of particulate amorphous oxide comprising silicon dioxide in an amount of 85% by weight or more, based on the total amount of the particulate amorphous oxide, preferably is

- in the range of from 0.01 to 3.0% by weight, preferably in the range of from 0.03 to 0.9% by weight, more preferably in the range of from 0.04 to 0.8% by weight, most preferably in the range of from 0.06 to 0.4% by weight, based on the total weight of broken material, and/or

- in the range of from 10 to 60% by weight, preferably in the range of from 13 to 50% by weight, more preferably in the range of from 20 to 40% by weight, most preferably in the range of from 25 to 35% by weight, based on the total weight of hardened water glass binder on the surface of the particles and/or the aggregates of particles of refractory material in the broken material.

The amount of the particulate amorphous oxide used in practice strongly depends on the amount of alkali metal ions on the surface of the particles and/or aggregates of particles of the broken material to be reclaimed (wherein the alkali metal ions on the surface of the particles and/or aggregates of particles of the broken material originate from the hardened water glass binder). The quantity should preferably be large enough to allow for complete conversion or reaction of the alkali metal ions with the particulate amorphous oxide. Since the amount of alkali metal ions depends strongly on the kind of broken material to be reclaimed, the amount of particulate amorphous oxide used must typically be adapted to the specific broken material to be reclaimed. Regarding the specific choice and determination of the respective suitable amount of particulate amorphous oxide reference is made to the above discussion, which applies here accordingly.

In the method according to the invention (as described above, in particular as designated as being preferred)

the particulate amorphous oxide comprising silicon dioxide in an amount of 85% by weight or more, based on the total amount of the particulate amorphous oxide, preferably has a $D_{90}$ of less than 100 μm, preferably less than 45 μm, more preferably less than 25 μm, most preferably less than 5 μm, and/or the particle size of the broken material preferably is in the range of from 100 to 600 μm, preferably in the range of from 120 to 550 μm, more preferably in the range of from 150 to 500 μm, and/or the ratio of the $D_{90}$ of the particulate amorphous oxide comprising silicon dioxide in an amount of 85% by weight or more, based on the total amount of the particulate amorphous oxide, to the size of the particles and/or aggregates of particles of refractory material in the broken material preferably is less than 1:1, preferably less than 1:10, more preferably less than 1:20, most preferably less than 1:120.

As already indicated above, it is beneficial for the realization of the method according to the present invention to provide for a particularly large surface area of the broken material (as well as of the particulate amorphous oxide) and an intensive (homogenous) mixture of the broken material and the particulate amorphous oxide. Since both of the above factors are favored by the presence of the smallest possible particles, the use of small particles of particulate amorphous oxide and small particles of broken material (as specified above) is preferred.

Throughout the present text, if not indicated otherwise, the term "particle size" relates to the particle diameter of the particles.

The "$D_{90}$" of the particulate amorphous oxide is a measured value derived from the particle size distribution of the particles in the total amount of this particulate amorphous oxide. In this respect, a $D_{90}$ of e.g. 100 μm means that 90% of the particles are smaller than 100 μm. The particle size distribution is determined in a way known by the skilled person, preferably by laser diffraction, e.g. by using a laser diffraction device as the Beckman Coulter LS 230 from the company Beckman Coulter.

The particle size of the broken material is preferably determined by a screening according to the VDG leaflet (i.e. the leaflet of the "Association of German foundry professionals") from 27 Oct. 1999, item 4.3. The analysis method described in the corresponding VDG leaflet is in accordance with DIN ISO 3310 (especially with respect to the test sieves used therein).

Also preferred (preferably according to the invention described above) is a method according to the invention (as described above, in particular as designated as being preferred) of preparing a particulate refractory composition for use in the manufacture of foundry moulds and cores from spent foundry moulds or cores formed of refractory material and a binder containing water glass, the method comprising the following steps:

providing broken material from spent foundry moulds or cores or preparing broken material from spent foundry moulds or cores, wherein the broken material comprises particles and/or aggregates of particles of refractory material having hardened water glass binder on their surface, mixing the broken material with particulate amorphous oxide comprising silicon dioxide in an amount of 85% by weight or more, based on the total amount of the particulate amorphous oxide, in the presence of an aqueous liquid phase, to give a mixture and subjecting the mixture to a heat treatment at a temperature in the range of from 400 to 750° C., preferably in the range of from 570 to 730° C., more preferably in the range of from 630 to 730° C., most preferably in the range of from 670 to 730° C., wherein the heat treatment is conducted in a fluidized bed.

With regard to the advantages associated with the use of the particulate amorphous oxide, in the presence of an aqueous liquid phase, the choice of a defined, preferred temperature range for the heat treatment or the conduction of the heat treatment in a fluidized, we refer to the respective foregoing discussions, which apply here accordingly.

In another, related aspect of the invention, the invention relates to the use of an aqueous suspension comprising an aqueous liquid phase comprising water in an amount of 80% by weight or more, based on the total amount of the liquid phase, and particulate amorphous oxide comprising silicon dioxide in an amount of 85% by weight or more, based on the total amount of the particulate amorphous oxide, as a constituent of a reclamation mixture comprising broken material from spent foundry moulds or cores, wherein the broken material comprises particles and/or aggregates of particles of refractory material having hardened water glass binder on their surface.

In a further aspect of the invention, the invention relates to a reclamation mixture for thermal treatment, comprising (i) broken material from spent foundry moulds or cores, wherein the broken material comprises particles and/or aggregates of particles of refractory material having hardened water glass binder on their surface, and (ii) an aqueous suspension comprising an aqueous liquid phase comprising water in an amount of 80% by weight or more, based on the total amount of the liquid phase, and particulate amorphous oxide comprising silicon dioxide in an amount of 85% by weight or more, based on the total amount of the particulate amorphous oxide.

All preferred embodiments of the method according to the invention discussed above, also apply to the aforementioned use of an aqueous suspension as well as to the reclamation mixture for thermal treatment, and vice versa, mutatis mutandis.

In a final aspect of the invention, the invention relates to a method of making a foundry mould or core comprising the following steps:

preparing a particulate refractory composition according to a method as defined above or in the attached claims (in particular as designated as being preferred), mixing the particulate refractory composition with a binder, preferably a water glass binder, shaping the resulting mixture, and curing the binder in said shaped mixture.

In own experiments it has been found that particulate refractory compositions prepared according to a method of the present invention for use in the manufacture of foundry moulds and cores exhibit an excellent low consumption of acid as well as an excellent low electrical conductivity.

Furthermore, foundry moulds and cores manufactured by using such particulate refractory compositions exhibit a superior binding strength (further details can be seen in the example section) and the castings, produced with the corresponding foundry moulds, have an excellent surface quality. The binder used in the method of making a foundry mould or core according to the invention is preferably a water glass binder as discussed above. Preferably, the binder comprises water glass and a particulate amorphous silicon dioxide. The presence of other or additional additives is also preferred (we refer to the above disclosure regarding the binder preferably additionally comprises one or more compounds selected from the group consisting of phosphorus-containing compounds, carbohydrates, surfactants, barium sulfate and oxid boron compounds which applies here as well).

In the method of making a foundry mould or core according to the invention (as described above), the binder (preferably, the water glass binder) is preferably cured by heat (e.g. by means of hot air). Foundry moulds or cores manufactured according to the method of the invention advantageously show excellent properties in the foundry and casting processes, and after use they can be recycled as discussed above. I.e., spent foundry moulds or cores manufactured according to the method of the invention can be broken, and the resulting broken material can be used as starting material in a method of the present invention of preparing a particulate refractory composition for use in the manufacture of foundry moulds and cores.

EXAMPLES

Example 1: Preparation and Composition of an Aqueous Suspension for Use as Constituent of Reclamation Mixtures for Thermal Treatment An aqueous suspension ("Suspension A") was prepared.

Suspension A is an aqueous suspension of 25% by weight of the silica fume SIF-A-T (Yingkou Imerys Astron Chemicals Co., Ltd; CAS-number: 69012-64-2; $SiO_2$-content=95% by weight) and 25% by weight of the phyllosilicate Satintone® W/Whitetex® (calcined kaolinite from BASF Catalysts LLC, screen residue by 325 Mesh=0.02%; avg. Stokes equivalent particle diameter=1.4 μm) in water. Both, the % by weight of silica fume as well as the % by weight of phyllosilicate, are based on the total amount of the suspension. The $D_{50}$ of the silica fume used is between 1 and 2 μm. The $D_{90}$ of the silica fume used is 4.485 μm.

Suspension A was prepared with procedures known in the art. This included mixing of the respective constituents (water, silica fume, phyllosilicate). Significant characteristics of Suspension A are summarized in Table 1.

TABLE 1

| | Suspension A |
|---|---|
| Water (liquid phase) [% by weight] | 50 |
| Satintone W (phyllosilicate) [% by weight] | 25 |
| Silica fume SIF-A-T (particulate amorphous oxide) [% by weight] | 25 |

TABLE 1-continued

| | Suspension A |
|---|---|
| pH | 4.6 |
| Color | white |

Example 2: Pilot Plant Trials

Pilot plant trials were carried out in a "Single Axis Attrition Flasher" (Chin Ying Foundry Material co. LTD) mechanical treatment machinery as well as in a "Energy-Saving Counter Flow Furnace "SX2-5-12 (Chin Ying Foundry Material co. LTD) fluidized bed. Both of the facilities were built by CHIN YING FOUNDRY MATERIAL (TIANJIN) CO., LTD and placed in its Tianjin plant, China. The pilot trials were carried out as follows:

Example 2.1: Preparation of Broken Material from Spent Foundry Cores, Preparation of a Reclamation Mixture, and Preparation of Particulate Refractory Compositions I) Spent foundry cores (previously used for aluminium casting) formed of refractory material (calcined quartz sand from the LIANXIN SAND GROUP; AFS value between 50 and 55; clay content less than 0.1%) and a binder system containing water glass (Cordis® 8593 from the company Huttenes-Albertus Chemische Werke GmbH) as well as particulate amorphous silica (Anorgit®8610 from the company Huttenes-Albertus Chemische Werke GmbH, comprising an amount of particulate amorphous silica of between 65 to 70% by weight, based on the total amount of Anorgit® 8610) were mechanically treated (i.e., broken) by conducting a single or two successive breaking steps. Herein, the material from the spent foundry cores is converted into broken material comprising particles and/or aggregates of particles of refractory material having hardened water glass binder on their surface.

a. In a first breaking step, a total amount of 1000 kg of spent foundry sand from said spent foundry cores was broken by an ordinary foundry crusher. The resulting broken material is subsequently labelled "Sample A".

b. In a second successive breaking step, a total amount of 750 kg of "Sample A" was further mechanically treated (broken) with a "Single Axis Attrition Flasher" mechanical facility. The Single Axis Attrition Flasher is a discontinuous facility. The second successive breaking step was carried out in three batches of 250 kg per batch. All three batches were treated by applying a power of 15 kW, a rotation speed of 1800 r/min and a treatment duration of 20 min. The resulting broken material is subsequently labelled "Sample B".

c. The resulting Sample A and Sample B, both comprising particles and/or aggregates of particles of refractory material having hardened water glass binder on their surface, were collected for further application.

II) Aqueous Suspension A was prepared according to "Example 1: Preparation and composition of an aqueous suspension for use as constituent of reclamation mixtures for thermal treatment".

III) The broken material of Sample B was treated in two different ways, (a) without and (b) with employment of Suspension A:

a. 300 kg of Sample B were fed to an "Energy-Saving Counter Flow Furnace SX2-5-12" fluidized bed, which was preheated to 730° C. There, sample B was subjected to a heat treatment for 1 hour at 730° C., subsequently smoldered for 4 hours without heating and subsequently cooled down. The resulting particulate refractory composition is subsequently labelled "Sample C".

b. Another 300 kg of Sample B were mixed with 3 kg of Suspension A, to give a homogeneous mixture of Sample B and Suspension A, i.e. a reclamation mixture for thermal treatment according to the invention. Afterwards, the resulting reclamation mixture for thermal treatment was subjected to the same (heat) treatment as described in step III) a. The resulting particulate refractory composition prepared by the method according to the invention is subsequently labelled "Sample D".

Example 2.2: Consumption of Acid, Electrical Conductivity and Optical Analysis of the Sand Grain Surfaces of the Broken Material from Spent Foundry Cores and of the Particulate Refractory Compositions Prepared According to Example 2.1

The consumption of acid (COA) and the electrical conductivity were measured and determined for Sample A, Sample B, Sample C, Sample D as well as for a new particulate refractory composition (i.e. calcined quartz sand from the LIANXIN SAND GROUP). The COA is a value used in inorganic, analytical chemistry (involving acid-base titration of a sample) to determine the alkali-content of a sample. The electrical conductivity value is measured to determine the content of conductive substances in a sample. Both values are directly related to the "cleanliness" of a sample. Low values of both COA and electrical conductivity indicate a high degree of sample cleanliness. A high cleanliness of particulate refractory compositions is preferred as clean materials generally show better properties when used in the manufacture of foundry moulds and cores. The cleanliness of the samples was furthermore evaluated by an analysis of the sand grain surfaces of the respective samples, by means of an optical microscope.

Determination of the Consumption of Acid (COA):

Devices Used for the Determination of the COA:

analytical balance (accuracy: ±0.01 g);
250 mL laboratory bottle with cap;
magnetic stirrer;
PTFE cylindrical magnetic stirrer bar (ca. 50×8 mm);
burette;
50 mL pipettes;
300 mL Erlenmeyer flasks (wide neck);
filter funnel;
filter paper;
filter holder.

Reagents Used for the Determination of the COA:

hydrochloric acid (0.1 mol/L);
sodium hydroxide solution (0.1 mol/L);
bromothymol blue (0.1% by weight in ethanol);
ultra-pure water.

For the determination of the consumption of acid, 50 g±0.01 of sample (Sample A, Sample B, Sample C, Sample D, and new particulate refractory composition) were weighed into a 250 mL laboratory bottle containing a magnetic stirrer bar. Subsequently, 50 mL of ultra-pure water and 50 mL of 0.1 mol/L hydrochloric acid were given into the laboratory bottle by using 50 mL pipettes. After closing the laboratory bottle with the cap, the resulting suspension was firstly stirred with a magnetic stirrer for 5 minutes was left afterwards for 1 hour. A blind suspension (i.e. without 50 g±0.01 of sample) was prepared in the same way.

Next, the suspensions obtained were filtered into an Erlenmeyer flask by using a filter system. The solid residue (filter cake) was then washed five times with 10 approximately millilitres of ultra-pure water each, whereby the washing water was added to the filtrate. After adding 4 to 5 drops of bromothymol blue indicator the filtrate (together with the washing water) was titrated from yellow to blue with 0.1 mol/L sodium hydroxide solution.

The COA was the calculated as follows:

$$COA[\text{g } HCL/\text{kg sample}] = (V_{blind}(\text{mL}) - V_{sample}(\text{mL})) \times \frac{100}{\text{weight of sample (g)}} \times 36.46 \times 0.001 \times 10$$

wherein, $V_{blind}$ is the consumed volume (mL) of 0.1 mol/L sodium hydroxide solution for the blind suspension, and $V_{sample}$ is the consumed volume (mL) of 0.1 mol/L sodium hydroxide solution for the corresponding suspension of Sample A, Sample B, Sample C, Sample D or new particulate refractory composition.

Determination of the Electrical Conductivity:

Devices Used for the Determination of the Electrical Conductivity:

Laboratory balance (accuracy=±0.01 g);
250 mL beaker;
PTFE cylindrical magnetic stirrer bar (ca. 50×8 mm);
Conductivity meter;
Measuring cylinder;
Heating plate.

Reagents Used for the Determination of the Electrical Conductivity:

Ultra-Pure water.

For the determination of the electrical conductivity 50±0.01 g of sample (Sample A, Sample B, Sample C, Sample D, and new particulate refractory composition) and approximately 100 mL ultra-pure water were given into the beaker. The resulting suspension was placed on a heating plate and was brought to boil. After 5 min of boiling, the suspension was cooled down to room temperature and subsequently the electrical conductivity was measured by using the conductivity meter.

Analysis of the Sand Grain Surfaces by Means of an Optical Microscope

The analysis of the sand grain surfaces of the samples (Sample A, Sample B, Sample C, Sample D, and new particulate refractory composition) was carried out by taking pictures of the sand grain surfaces using an optical microscope (VHX550/1000D, Keyence). The assessment of cleanliness analyzed by means of an optical microscope was conducted on the basis of a scale from "1" to "5", wherein 1 stands for "very clean" (no or almost no impurities—such as remaining hardened water glass—are visible on the surface of the particles examined) and 5 stands for "very dirty" (i.e. large amounts of impurities—such as remaining hardened water glass—are visible on the surface of the particles examined).

The results regarding the determination of the consumption of acid (COA), the determination of the electrical conductivity and the analysis of the sand grain surfaces by means of an optical microscope are summarized in Table 2.

TABLE 2

| | Sample | COA [g HCl/kg sample] | Electrical conductivity [μS/cm] | Assessment of cleanliness analyzed by means of an optical microscope |
|---|---|---|---|---|
| Reference samples | A | 24.1 | 1876 | 5 |
| | B | 17.7 | 1294 | 4 |
| | C | 5.2 | 128 | 3 |
| Particulate refractory composition prepared by the method according to the invention (using suspension A) | D | 5.0 | 87 | 2 |
| Reference sample | New particulate refractory composition | 4.5 | 30 | 1 |

As can be seen from Table 2, the values for the consumption of acid (COA), the electrical conductivity and the cleanliness analyzed by means of an optical microscope for "Sample D" (i.e. the reclaimed particulate refractory composition prepared by the method according to the invention) are close to the ideal values represented by the reference sample of "New particulate refractory composition". When comparing "Sample D" with "Samples A" and "Sample B" (i.e. broken material from spent foundry cores prepared by mechanical treatment, without additional heat treatment in fluidized bed), it should be noted that the values for COA, electrical conductivity and cleanliness analyzed by means of an optical microscope are significantly improved by the method according to the invention (Sample D). In addition, a direct comparison of "Sample D" with "Sample C" (i.e. a reclaimed particulate refractory composition, wherein the broken material used for preparing the particulate refractory composition was not mixed with particulate amorphous oxide and phyllosilicate prior to the heat treatment) demonstrates that "Sample D" shows better values in terms of COA, electrical conductivity and cleanliness analyzed by means of an optical microscope.

In summary, the results listed in Table 2 above show that the method according to the invention results in the preparation of particulate refractory compositions (from spent foundry cores) with extraordinary properties, which is not feasible with methods typically used in the art.

Additional investigations have also shown that a method according to the invention using an aqueous suspension of 50% by weight of the silica fume SIF-A-T in water, based on the total amount of the suspension (i.e. using a suspension not comprising phyllosilicate), leads to a particulate refractory composition with outstanding properties as well, wherein the measured values regarding COA, electrical conductivity and cleanliness analyzed by means of an optical microscope for the (reclaimed) particulate refractory composition prepared by the said suspension are almost as good as those of "Sample D", and better than those of "Sample A", "Sample B" or "Sample C".

Example 3: Making of Foundry Cores for Casting Trials

Example 3.1: Making of Foundry Cores by Use of the Materials According to "Sample A", "Sample B", "Sample C" (not in Accordance with the Invention) and "Sample D" (in Accordance with the Invention) Prepared According to Example 2.1

"Sample A", "Sample B", "Sample C", "Sample D" as well as a new particulate refractory composition ((i.e. calcined quartz sand from the LIANXIN SAND GROUP) were used to make specimen representing foundry cores (bending bars, dimensions: 22.4 mm×22.4 mm×178.0 mm).

Before foundry cores were made, the AFS values of the materials according to "Sample A", "Sample B", "Sample C" and "Sample D" as well as the "AFS value" of a new particulate refractory composition were determined based on the determination method described in the "VDG Merkblatt P 27". According to the "VDG Merblatt R 202", the AFS value is a parameter defined by the American Foundrymen's Society (AFS) to characterize the grain size. In this respect, the AFS value indicates the mesh count per inch of the sieve through which the material inspected would pass if it had a uniform grain size. To determine the AFS values, 100 g±0.01 g of each sample were weighted on a sieve tower (including a sieve set with sieves of the following meshes: 1.000 mm, 0.710 mm, 0.500 mm, 0.355 mm, 0.250 mm, 0.180 mm, 0.125 mm, 0.090 mm, 0.063 mm). The sieve tower was operated with an amplitude of 1.0 mm for 5 min, while the interval was set to 0 s. After completion of sieving the content of each sieve was weighted and the AFS value was calculated by using following equation:

$$AFS = \frac{\Sigma\, g_i \cdot M3_i}{g}$$

wherein g is the total mass, $g_i$ is the mass of the individual grain classes (e.g. 1.000 mm to 0.710 mm) and $M3_i$ is the multiplication factor of the individual grain classes (as listed in "VDG Merkblatt P 27").

For making of the foundry cores (bending bars) 2.2 parts by weight of a binder containing water glass (Cordis® 8593 from the company Hüttenes-Albertus Chemische Werke GmbH, i.e. a water glass binder) and 1.3 parts by weight of an additive (Anorgit® 8610 from the company Hüttenes-Albertus Chemische Werke GmbH having an amount of particulate amorphous silica of between 65 to 70% by weight, based on the total amount of Anorgit® 8610) were homogenized (mixed) with 100 parts by weight (3500 g) of "Sample A", "Sample B", "Sample C", "Sample D" or a new particulate refractory composition. Subsequently, foundry cores were made from the resulting mixtures by shooting using a "Universal Core Shooter (LUT)" from the company Morek Multiserw. The shooting of the foundry cores includes a shaping of the corresponding mixtures as well as curing of the binder in said shaped mixtures. The parameters for shooting of the foundry cores are listed Table 3.

TABLE 3

| | |
|---|---|
| Shooting pressure | 4.5 bar |
| Duration of shooting | 3 s |
| Curing time | 30 s |
| Core box temperature | 180° C. |
| Gas | air |
| Gassing time | 30 s |
| Gas temperature | 180° C. |

Ten foundry cores (bending bars) for each sample ("Sample A", "Sample B", "Sample C", "Sample D" and new particulate refractory composition) were made by the method stated above. The resulting foundry cores (bending bars) were used for core strength tests as well as for casting trials.

The core strength of foundry cores (bending bars) was tested in warm status (i.e. 15 s after shooting) as well as in cold status (i.e. 1 h after shooting). Each test regarding the core strength was repeated three times for each foundry core composition. The mean value was then calculated from each of the three measured values. The laboratory (in which the core strength tests were conducted) was air-conditioned with temperatures between 21 and 22° C. and a relative humidity between 44 and 45%. A sufficiently high core strength is one prerequisite for the use of a foundry mould or core for the purpose of casting.

Besides, seven bending bars per foundry core composition were weighed in cold status to obtain mean weights of the foundry cores. The mean weights of the foundry cores indicate how easy or difficult it is to compact the respective cores. The lower the mean weight of the foundry cores, the easier it is to compact the foundry cores. A high mean weight of a foundry core corresponds to a high compaction and usually means that the respective foundry core also shows improved values regarding strength and humidity resistance.

The results regarding the core strengths and the core weights of the foundry cores as well as the AFS values of the materials, used for making the foundry cores, are summarized in Table 4. The core strength values listed in Table 4 represent average values of the triple measurements carried out.

TABLE 4

| Sample | Core strength tested in warm status [N/cm$^2$] | Core strength tested in cold status [N/cm$^2$] | Mean core weight [g] | AFS value |
|---|---|---|---|---|
| A | 160 | 350 | 149.7 | 40 |
| B | 210 | 430 | 158.0 | 50 |
| C | 200 | 430 | 159.3 | 46 |
| D | 200 | 430 | 158.8 | 46 |
| New particulate refractory composition | 180 | 370 | 157.1 | 52 |

As can be seen from Table 4, the core strengths of foundry cores made by using "Sample A", "Sample B", "Sample C" or "Sample D" are close to (or even higher than) the core strengths of the foundry cores made by using a new particulate refractory composition. Furthermore, with exception of "Sample A", the mean core weights of said samples are higher than the mean core weight of the foundry cores made by using a new particulate refractory composition. The AFS values of the broken materials from "Sample A", "Sample B", "Sample C", and "Sample D" are in general smaller than (but in the same region as) the AFS value of the new particulate refractory composition.

Example 3.2: Casting Trials by Use of the Foundry Cores Made According to Example 3.1

Three foundry cores (bending bars) of each foundry core composition (A, B, C, D, new) were casted with an aluminum alloy. Details regarding the casting conditions are listed in Table 5.

TABLE 5

| | |
|---|---|
| Casting temperature | 710° C. |
| Pouring time | 13-15 s |
| Name of foundry | Daihatsu Tianjin Plant |

Details regarding the composition of the aluminum alloy used are listed in Table 6.

TABLE 6

| Components which (in addition to aluminium), are contained in the aluminium alloy used | Amount [% by weight, based on the total amount of the aluminum alloy] |
|---|---|
| Cu | 2.56 |
| Si | 8.71 |
| Mg | 0.33 |
| Zn | 0.82 |
| Fe | 0.81 |
| Mn | 0.29 |
| Na | 0.003811 |

After the casting, the grade of casting surface quality for the castings obtained was assessed. The grade of casting surface quality was assessed on the basis of a scale from "1" to "4", wherein "1" stands for a very good and "4" for a very poor surface quality of the castings obtained.

The results regarding the grades of casting surface quality for the castings obtained are summarized in Table 7. The given grades of casting surface quality represent in each case an overall assessment of all foundry cores of the same composition.

TABLE 7

| Sample | Grade of casting surface quality * |
|---|---|
| A | 4 |
| B | 4 |
| C | 2 |
| D | 1 |

TABLE 7-continued

| Sample | Grade of casting surface quality * |
|---|---|
| New particulate refractory composition | 3 |

Regarding the grade of casting surface quality, castings produced by the use of foundry cores made of "Sample D" (i.e. made of the particulate refractory composition prepared by the method according to the invention) show the best results. The grade of casting surface quality of such castings is significantly better compared to the grade of casting surface quality of castings produced by the use of foundry cores made of "Sample A" and "Sample B" (i.e. made of broken material) and also better compared to the grade of casting surface quality for castings made of "Sample C" (i.e. made of a reclaimed particulate refractory composition, wherein the broken material used for preparing the particulate refractory composition was not mixed with particulate amorphous oxide and phyllosilicate prior to the heat treatment) or made of a new particulate refractory composition.

Castings with a superior grade of casting surface quality were also obtained by foundry cores made of a reclamation mixture which was prepared by a method according to the invention, wherein the broken material used was mixed with an aqueous suspension of 50% by weight of the silica fume SIF-A-T in water, based on the total amount of the suspension, prior to the heat treatment.

Example 4: Repetition of Examples 2.1 to 3.2 by Using a Different Spent Foundry Core Composition as Starting Material The above Examples 2.1 to 3.2 were generally repeated. However, the spent foundry cores (which were used for preparing broken material, comprising particles and/or aggregates of particles of refractory material having hardened water glass binder on their surface) were formed of a refractory material different from those used in Example 2.1 (in particular, Mongolia quartz sand from the Ma'anshan Shenzhou Sand Corporation was used in Example 4), a binder containing water glass (Cordis®8593 from the company Huttenes-Albertus Chemische Werke GmbH) and an additive (Anorgit® 8610 from the company Huttenes-Albertus Chemische Werke GmbH).

The determination of COA, electrical conductivity, core strengths, mean core weight and AFS value as well as the assessment of cleanliness analyzed by means of an optical microscope and the assessment of the grade of casting surface quality were conducted in the same manner as described above. The corresponding results are summarized in Table 8. "Sample A.2", "Sample B.2", "Sample C.2" and "Sample D.2" were obtained in analogy to "Sample A", "Sample B", "Sample C" and "Sample D", respectively. The reference sample "New particulate refractory composition" of Table 8 corresponds to a sample made by using new refractory material (i.e. Mongolia quartz sand from the Ma'anshan Shenzhou Sand Corporation).

TABLE 8

| Sample | COA [g HCl/kg sample] | Electrical conductivity [μS/cm] | Assessment of cleanliness analyzed by means of an optical microscope | Core strength tested in warm status [N/cm$^2$] | Core strength tested in cold status [N/cm$^2$] | Mean core weight [g] | AFS value | Grade of casting surface quality * |
|---|---|---|---|---|---|---|---|---|
| A.2 | 28.8 | 1510 | 5 | 89 | 180 | 138.4 | 44 | 4 |
| B.2 | 22 | 1370 | 5 | 140 | 300 | 153.5 | 54 | 3 |
| C.2 | 12.6 | 200 | 3 | 140 | 280 | 150.4 | 45 | 2 |
| D.2 | 10 | 90 | 2 | 130 | 280 | 150.4 | 43 | 1 |
| New particulate refractory composition | 7 | 40 | 1 | 130 | 230 | 154.0 | 52 | 1 |

As can be seen from Table 8, the refractory composition prepared by the method according to the invention ("Sample D.2") shows also in this case the best values with regard to COA, electrical conductivity, assessment of cleanliness analyzed by means of an optical microscope, and grade of casting compared to the according reference samples ("Sample A.2", "Sample B.2" and "Sample C.2"). Thus, the method according to the invention offers particularly advantageous properties (regardless of the composition of the spent foundry mould or core used) in comparison with methods known from the state of the art.

We claim:

1. A method of preparing a particulate refractory composition for use in the manufacture of foundry moulds and cores from spent foundry moulds or cores formed of refractory material and a binder containing water glass, the method comprising the following steps:

providing broken material from spent foundry moulds or cores or preparing broken material from spent foundry moulds or cores, wherein the broken material comprises particles and/or aggregates of particles of refractory material having hardened water glass binder on their surface, mixing the broken material with particulate amorphous oxide comprising silicon dioxide in an amount of 85% by weight or more, based on the total amount of the particulate amorphous oxide, to give a mixture and subjecting the mixture to a heat treatment at a temperature of 400° C. or higher.

2. The method according to claim 1, wherein the heat treatment is at a temperature in the range of from 400 to 750° C.

and/or is conducted in a fluidized bed or thermal sand reclamation unit, wherein simultaneous with or after the heat treatment in the fluidized bed or thermal sand reclamation unit dust and/or fines and/or solid matter comprising alkali ions are removed.

3. The method according to claim 2, wherein the heat treatment is at a temperature in the range of from 570 to 730° C.

4. The method according to claim 1, wherein the step of preparing broken material from spent foundry moulds or cores, wherein the broken material comprises particles and/or aggregates of particles of refractory material having hardened water glass binder on their surface, comprises a mechanical treatment of material from spent foundry moulds or cores comprising refractory material and a binder containing water glass so that the material is broken, wherein the broken material comprises particles of refractory material having hardened water glass binder on their surface and/or the mechanical treatment comprises two or more successive breaking steps in order to convert the material from spent foundry moulds or cores comprising refractory material and a binder containing water glass into particles and/or aggregates of particles of refractory material having hardened water glass binder on their surface.

5. The method according to claim 4, with the following steps in the process of preparing broken material from spent foundry moulds or cores:

producing a moulding mixture comprising refractory material and a binder containing water glass and a particulate amorphous silicon dioxide, moulding of the moulding mixture, curing of the moulding mixture to give a cured foundry mould or core, using the cured foundry mould or core in a metal casting process to give a spent foundry mould or core.

6. The method according to claim 5, wherein the binder additionally comprises one or more compounds selected from the group consisting of phosphorus-containing compounds, selected from the group consisting of sodium metaphosphate, sodium polyphosphate and mixtures thereof, carbohydrates, surfactants, barium sulfate, and oxidic boron compounds, selected from the group consisting of borates, borophosphates, borophosphosilicates and mixtures thereof.

7. The method according to claim 1, wherein the step of mixing the broken material with the particulate amorphous oxide is conducted in the presence of a liquid phase, wherein the step of mixing is conducted in the presence of one or more organic compounds as constituents of the aqueous liquid phase, and/or in the step of mixing the broken material with the particulate amorphous oxide the broken material is mixed with a suspension of the particulate amorphous oxide in a liquid phase, wherein the liquid phase is an aqueous liquid phase.

8. The method according to claim 7, wherein the liquid phase is an aqueous liquid phase comprising water in an amount of 80% by weight or more, based on the total amount of the liquid phase.

9. The method according to claim 1, wherein the broken material is also mixed, simultaneously or successively, with one or more materials selected from the group consisting of
phyllosilicates, selected from the group consisting of kaolinite, metakaolin, montmorillonite, halloysite, hectorite, smectite, muscovite, pyrophyllite, synthetic phyllosilicates and mixtures thereof,
suspending agents,
wetting agents,
dispersing agents,
anti-settling agents,
dyes,
pigments,
biocides,
zeolites, and
aluminium hydroxide.

10. The method according to claim 9, wherein the phyllosilicates are partially or completely calcined.

11. The method according to claim 9, wherein the phyllosilicates are provided as a pre-mixed suspension in a liquid phase also comprising the particulate amorphous oxide, wherein the liquid phase is an aqueous liquid phase comprising water in an amount of 80% by weight or more, based on the total amount of the liquid phase.

12. The method according to claim 1, wherein the particulate amorphous oxide comprising silicon dioxide in an amount of 85% by weight or more, based on the total amount of the particulate amorphous oxide, comprises one more substances selected from the group consisting of
silica fume,
selected from the group consisting of
silica obtained by oxidation of metallic silicon with an oxygen containing gas, and
silica obtained by thermal decomposition of $ZrSiO_4$ to $ZrO_2$ and $SiO_2$,
amorphous silica,
precipitated silicic acid,
pyrogenic silicic acid, and
silica obtained by atomization of a silica melt and subsequent solidification.

13. The method according to claim 1, wherein the total amount of particulate amorphous oxide comprising silicon dioxide in an amount of 85% by weight or more, based on the total amount of the particulate amorphous oxide, is
in the range of from 0.01 to 3.0% by weight, based on the total weight of broken material, and/or
in the range of from 10 to 60% by weight, based on the total weight of hardened water glass binder on the surface of the particles and/or the aggregates of particles of refractory material in the broken material.

14. The method according to claim 13, wherein the total amount of particulate amorphous oxide comprising silicon dioxide in an amount of 85% by weight or more, based on the total amount of the particulate amorphous oxide, is
in the range of from 0.03 to 0.9% by weight, based on the total weight of broken material, and/or
in the range of from 13 to 50% by weight, based on the total weight of hardened water glass binder on the surface of the particles and/or the aggregates of particles of refractory material in the broken material.

15. The method according to claim 1, wherein
the particulate amorphous oxide comprising silicon dioxide in an amount of 85% by weight or more, based on the total amount of the particulate amorphous oxide, has a $D_{90}$ of less than 100 μm,
and/or
the particle size of the broken material is in the range of from 100 to 600 μm, and/or
the ratio of the $D_{90}$ of the particulate amorphous oxide comprising silicon dioxide in an amount of 85% by weight or more, based on the total amount of the particulate amorphous oxide, to the size of the particles and/or aggregates of particles of refractory material in the broken material is less than 1:1.

16. The method according to claim 15, wherein
the particulate amorphous oxide comprising silicon dioxide in an amount of 85% by weight or more, based on the total amount of the particulate amorphous oxide, has a $D_{90}$ of less than 45 μm,
and/or
the particle size of the broken material is in the range of from 120 to 550 μm,
and/or
the ratio of the $D_{90}$ of the particulate amorphous oxide comprising silicon dioxide in an amount of 85% by weight or more, based on the total amount of the particulate amorphous oxide, to the size of the particles and/or aggregates of particles of refractory material in the broken material is less than 1:10.

17. The method according to claim 1, of preparing a particulate refractory composition for use in the manufacture of foundry moulds and cores from spent foundry moulds or cores formed of refractory material and a binder containing water glass,
the method comprising the following steps:
providing broken material from spent foundry moulds or cores or preparing broken material from spent foundry moulds or cores, wherein the broken material comprises particles and/or aggregates of particles of refractory material having hardened water glass binder on their surface,
mixing the broken material with particulate amorphous oxide comprising silicon dioxide in an amount of 85% by weight or more, based on the total amount of the particulate amorphous oxide, in the presence of an aqueous liquid phase, to give a mixture
and
subjecting the mixture to a heat treatment at a temperature in the range of from 400 to 750° C., wherein the heat treatment is conducted in a fluidized bed.

18. A method of reclamation, comprising:
providing an aqueous suspension comprising
an aqueous liquid phase comprising water in an amount of 80% by weight or more, based on the total amount of the liquid phase,
and
particulate amorphous oxide comprising silicon dioxide in an amount of 85% by weight or more, based on the total amount of the particulate amorphous oxide,
wherein the aqueous suspension is a constituent of a reclamation mixture comprising broken material from spent foundry moulds or cores, wherein the broken material comprises particles and/or aggregates of particles of refractory material having hardened water glass binder on their surface.

19. A reclamation mixture for thermal treatment, comprising:
(i) broken material from spent foundry moulds or cores, wherein the broken material comprises particles and/or aggregates of particles of refractory material having hardened water glass binder on their surface, and (ii) an aqueous suspension comprising an aqueous liquid phase comprising water in an amount of 80% by weight or more, based on the total amount of the liquid phase, and particulate amorphous oxide comprising silicon dioxide in an amount of 85% by weight or more, based on the total amount of the particulate amorphous oxide.

20. The method of making a foundry mould or core comprising the following steps:

preparing a particulate refractory composition according to a method as defined in claim 1, mixing the particulate refractory composition with a binder, shaping the resulting mixture, and curing the binder in said shaped mixture.

* * * * *